US011229244B2

(12) United States Patent
Pettet

(10) Patent No.: US 11,229,244 B2
(45) **Date of Patent: *Jan. 25, 2022**

(54) PANTS WITH BI-DIRECTIONAL ZIPPERED FLY

(71) Applicant: TLP BUSINESS SERVICES LLC, Westlake, OH (US)

(72) Inventor: Timothy L. Pettet, Rocky River, OH (US)

(73) Assignee: TLP Business Services LLC, Westlake, OH (US)

( * ) Notice: Subject to any disclaimer, the term of this patent is extended or adjusted under 35 U.S.C. 154(b) by 41 days.

This patent is subject to a terminal disclaimer.

(21) Appl. No.: 16/385,087

(22) Filed: Apr. 16, 2019

(65) Prior Publication Data

US 2019/0239575 A1 Aug. 8, 2019

Related U.S. Application Data

(62) Division of application No. 14/623,439, filed on Feb. 16, 2015, now Pat. No. 10,264,827.

(60) Provisional application No. 61/940,666, filed on Feb. 17, 2014.

(51) Int. Cl.

| | |
|---|---|
| ***A41D 1/06*** | (2006.01) |
| ***A44B 19/24*** | (2006.01) |
| ***A41F 1/00*** | (2006.01) |

(52) U.S. Cl.

CPC ..... *A41D 1/06* (2013.01); *A41F 1/008* (2013.01); *A44B 19/24* (2013.01)

(58) Field of Classification Search

CPC ..... A41D 1/06; A41F 1/008; A44B 19/24
USPC ..... 2/234
See application file for complete search history.

(56) References Cited

U.S. PATENT DOCUMENTS

| | | | | |
|---|---|---|---|---|
| 2,226,248 | A * | 12/1940 | Lunken | E04B 1/30 52/764 |
| 2,277,068 | A | 3/1942 | Bulloch | |
| 2,622,248 | A | 12/1952 | Schaye | |
| 4,099,301 | A | 7/1978 | Fujisaki | |
| 4,578,828 | A | 4/1986 | Smith, Sr. et al. | |
| 5,010,595 | A * | 4/1991 | Stradley | A41D 1/06 2/227 |
| 5,983,401 | A | 11/1999 | Ohara | |
| 6,243,878 | B1 | 6/2001 | Khemka et al. | |
| 6,928,661 | B2 * | 8/2005 | Lewis | A41D 1/06 2/227 |
| D628,517 | S | 12/2010 | Bitzan | |

(Continued)

*Primary Examiner* — Alissa J Tompkins
*Assistant Examiner* — Catherine M Ferreira
(74) *Attorney, Agent, or Firm* — Rankin, Hill & Clark LLP

(57) ABSTRACT

A pair of pants including a fly that can be opened and closed via a bi-directional zipper that extends from a top end proximal to an upper terminus of the pants to a bottom end at the crotch point of the pants. The zipper includes a top slider and a bottom slider that travel on a common set of zipper teeth. The top slider separates the zipper teeth when moved in a direction away from the top end toward the bottom end and closes the zipper teeth when moved in the opposite direction. The bottom slider separates the zipper teeth when moved in a direction toward the top end and away from the bottom end and closes the zipper teeth when moved in the opposite direction. The pants allow a wearer to excrete urine while in a sitting position, particularly such as when the wearer is operating an aircraft.

3 Claims, 6 Drawing Sheets

(56) References Cited

U.S. PATENT DOCUMENTS

| | | | | |
|---|---|---|---|---|
| 7,926,122 | B1 | 4/2011 | Countryman | |
| 8,533,918 | B1 | 9/2013 | Ketter | |
| 8,881,314 | B2 | 11/2014 | McCombs | |
| 2002/0040496 | A1 | 4/2002 | Blaire | |
| 2005/0268438 | A1* | 12/2005 | Chung | A44B 19/262 24/386 |
| 2009/0222968 | A1 | 9/2009 | Pisano-Grinter | |
| 2011/0167537 | A1 | 7/2011 | Christoff | |

* cited by examiner

PANTS WITH BI-DIRECTIONAL ZIPPERED FLY

CROSS-REFERENCE TO RELATED APPLICATION

This application is a division of U.S. application Ser. No. 14/623,439, filed Feb. 16, 2015, now U.S. Pat. No. 10,264,827 B2, and claims priority to U.S. Provisional Pat. App. Ser. No. 61/940,666, filed Feb. 17, 2014.

BACKGROUND OF INVENTION

Field of Invention

The present invention relates to pants and, more particularly, to pants provided with an elongate bi-direction zippered fly.

Description of Related Art

Pilots of smaller aircraft are sometimes presented with a particularly distressing problem, namely the urgent need to urinate and the inability to leave the pilot seat in order to do so. There are several prior art solutions to this problem, none of which are particularly satisfactory.

Some pilots don adult incontinence diapers and simply urinate into them when the need arrives. This is the worst solution of all, because it makes the pilot sit in a damp situation for a potentially long period of time. Plus, the diaper is uncomfortable to sit in and to walk around in, both before and after use.

There are a variety of products marketed to pilots to address this problem. One product, which is sold under the brand name TRAVEL JOHN, consists of a pouch that contains a material that gels instantly when contacted with urine. Another product, which is sold under the brand name LITTLE JOHN, consists of a plastic container that can be used to contain urine in a spill-proof manner. Another product, which is sold under the brand name GOPILOT, consists of a handheld portable urinal that includes a flexible tube connected to a reservoir. Another frequently utilized method for dealing with urine is to install a relief tube in the aircraft, which drains the urine from the cabin to the atmosphere rather than collecting it in a reservoir in the cabin.

Each of the foregoing products, other than the adult incontinent diapers, require the pilot to unzip his or her pants in order to allow for the excretion of urine. Pants, however, are not designed for human beings to accomplish this task while in a seated position. Thus, it can be quite difficult to utilize any of the above-mentioned products while in flight.

One prior art solution to this issue was sold in the marketplace under the brand name PEETOT PANTS. This product featured a zipper that ran laterally from mid-thigh on one leg of the pants to mid-thigh on the other leg of the pants. In flight, a pilot could laterally unzip the zipper, excrete urine while seated, and then re-zip the pants. One problem with these prior art pants is that the lateral zipper was folded at the crotch, and rubbed (chafed) during walking, which made the pants uncomfortable.

BRIEF SUMMARY OF THE INVENTION

In view of the foregoing, the present invention is directed toward pants provided with an elongate bi-direction zippered fly. The bi-directional zipper includes a top slider that can be lowered from an uppermost stopping point just below the waist line like most pants. However, there is also a bottom slider that can be raised from a bottommost stopping point near the crotch seam of the pants, which allows the wearer to unzip the pants from the stopping point in a direction toward the waist line in order to open the fly and excrete urine while in a sitting position.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
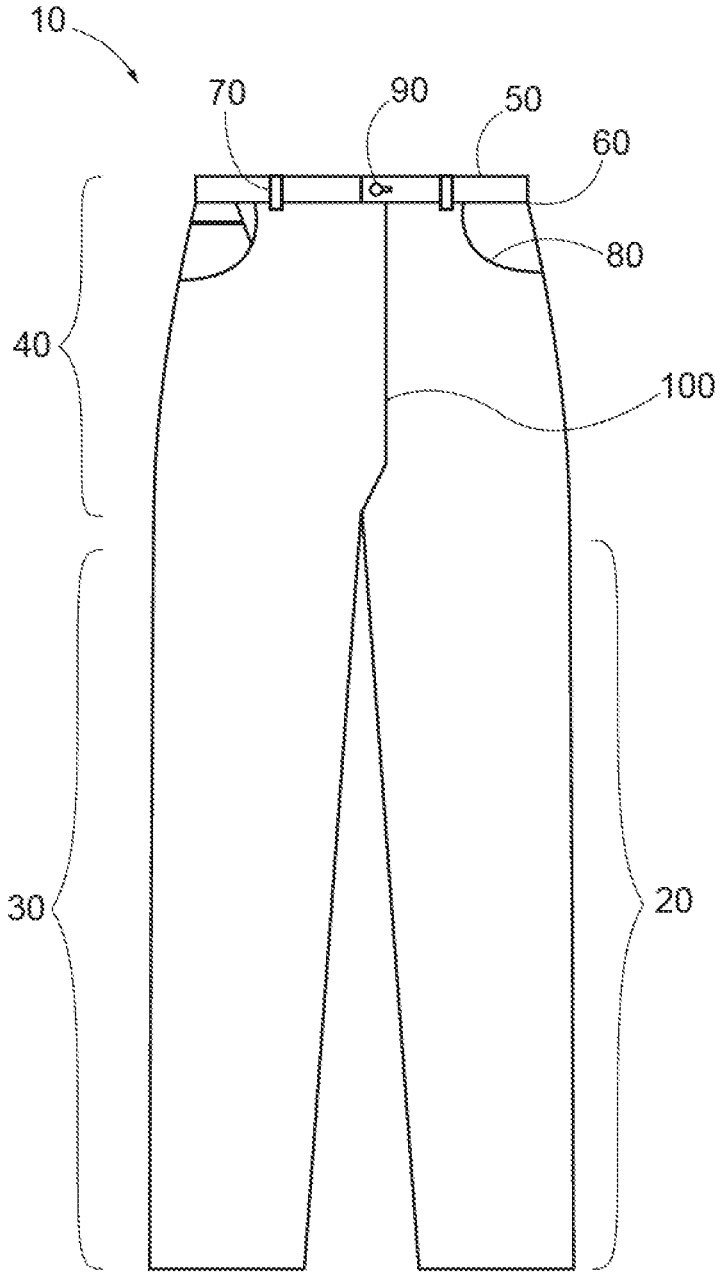
FIG. 1 is a schematic front view of a pair of pants according to the invention.

As noted above, FIG. 1 shows a schematic front view of a pair of pants 10 according to the invention. The pants 10 include a portion 20 for receiving a left leg of a human and a portion 30 for receiving a right leg of a human. The portions 20, 30, are joined together in a portion 40 for surrounding the lower torso of a human. The pants 10 terminate in an upper edge 50 immediately above a belt line 60. In this embodiment, belt loops 70 are provided at the belt line, and are adapted for securing a belt to the pants 10. As is conventional, the pants 10 include pockets 80. The pants can be separated by unfastening a closure 90, which in this embodiment is a button secured to one side of the pants 10, which is received in a button hole provided on the other side of the pants 10. The pants 10 can be further separated by opening a fly 100.

Figure 2:
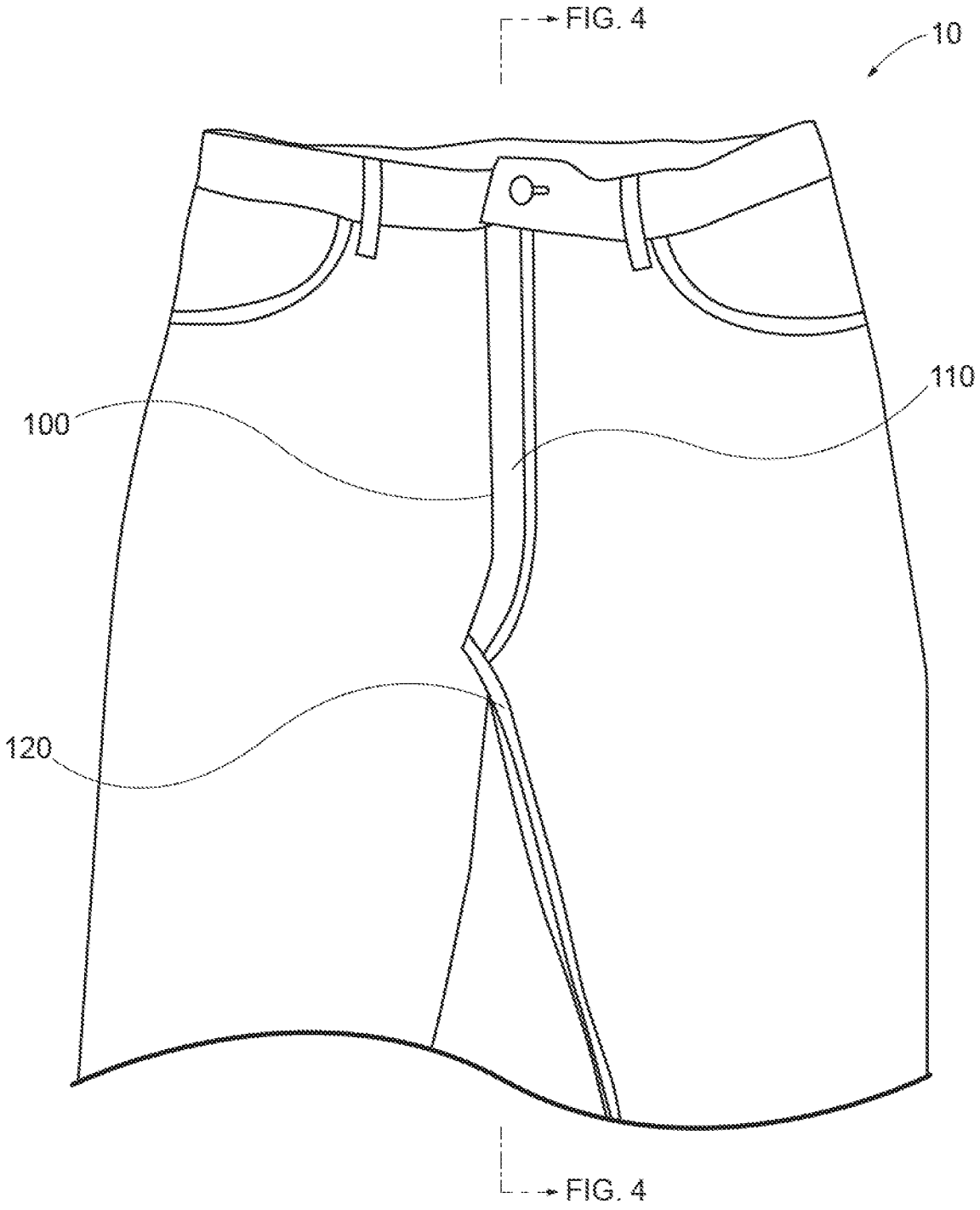
FIG. 2 is a front view of an upper portion of a pair of pants according to one embodiment of the invention.

FIG. 2 is a front view of an upper portion of a pair of pants 10 according to one embodiment of the invention. FIG. 2 shows that the fly includes an outer flap portion 110, which is straight as it descends from the closure 90, but curves as it approves a lateral crotch seam 120. The flap conceals a bi-directional zipper 130, which is not visible in FIG. 2.

Figure 3:
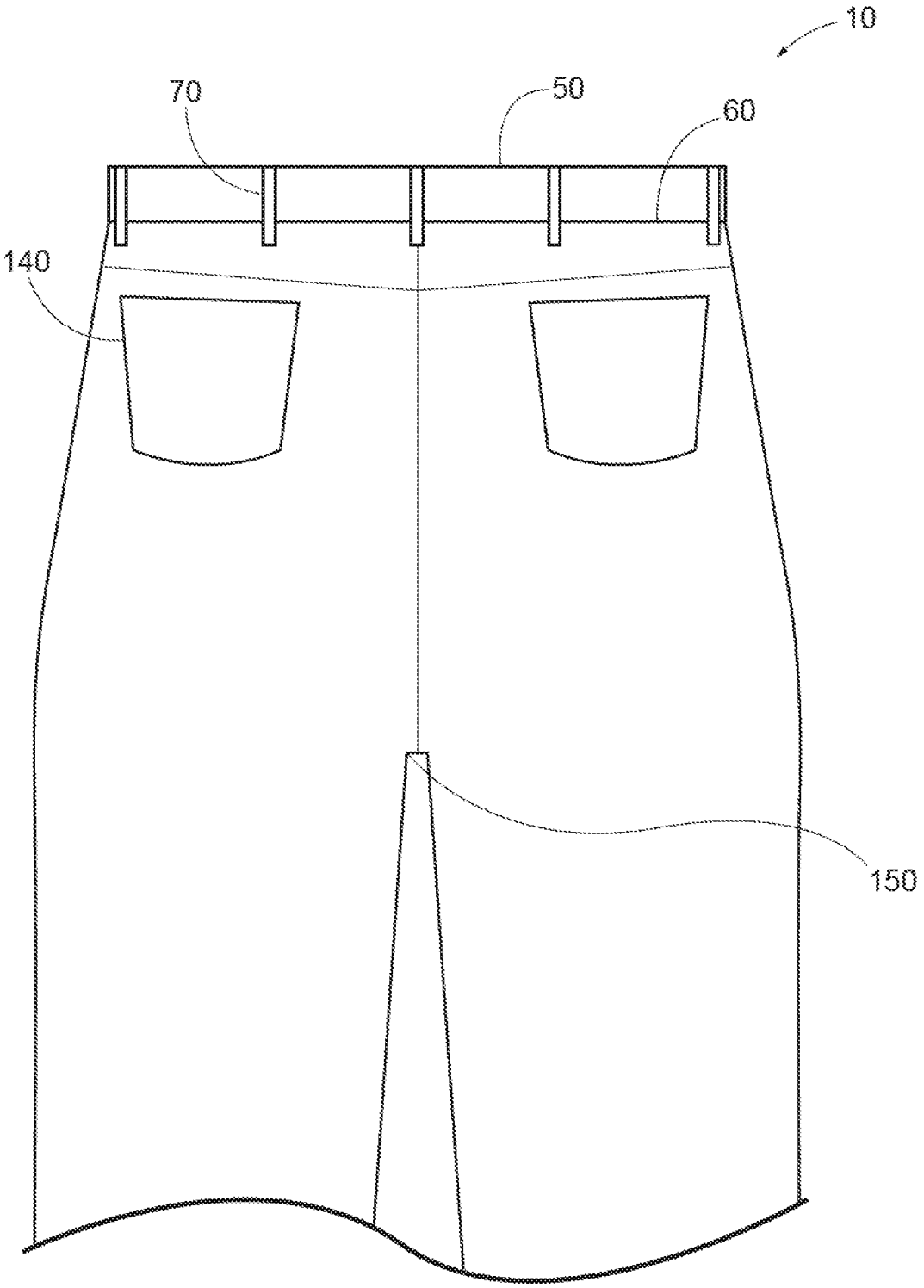
FIG. 3 is rear view of an upper portion of a pair of pants according to one embodiment of the invention.

FIG. 3 is rear view of an upper portion of a pair of pants 10 according to one embodiment of the invention. The fly 100 and bi-directional zipper 130 do not extend to the rear of the pants 10, which thus appear conventional in that respect. The pants 10 can include rear pockets 140, if desired.

Figure 4:
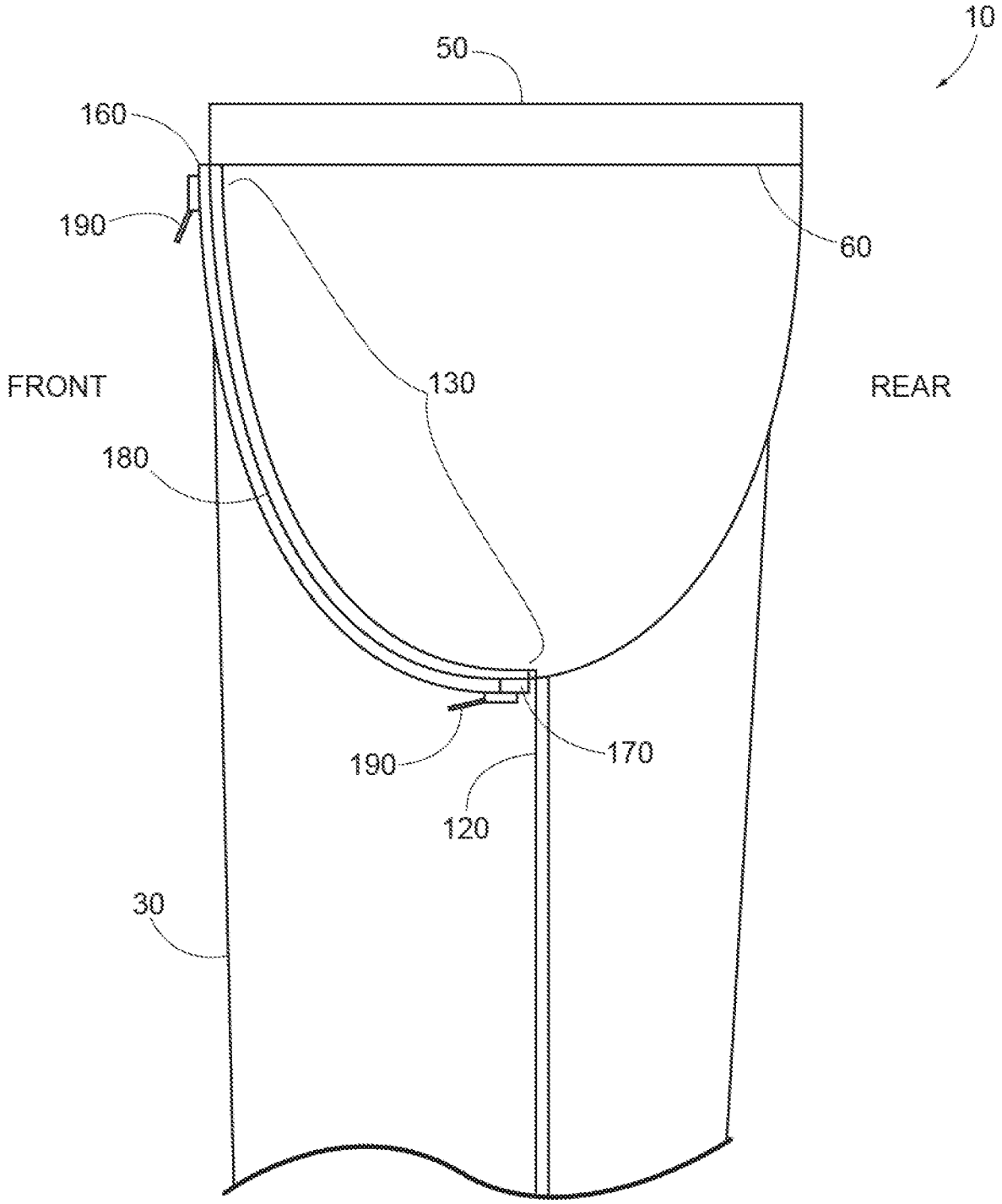
FIG. 4 is a schematic side section view through the pair of pants shown in FIG. 2 along the line IV-IV.

FIG. 4 is a schematic side section view through the pair of pants shown in FIG. 2 along the line IV-IV. The bi-directional zipper 130 extends from a seam just below the belt line 60 to the crotch 150 of the pants. The bi-directional zipper 130 includes an upper slider 160, and a lower slider 170, which travel on a common set of zipper teeth 180. The upper slider 160 unzips (i.e., opens) the common set of zipper teeth 180 as it moves in a downward direction, which is the direction of travel along the zipper from below the belt line 60 toward the crotch 150, and zips together (i.e. closes) the common set of zipper teeth 180 as it moves in an upward direction, which is the direction of travel from the crotch 150 toward the belt line 60. The lower slider 170 functions in the opposite manner, meaning that the lower slider 170 unzips (i.e., opens) the common set of zipper teeth 180 as it moves in the upward direction, and zips together (i.e. closes) the common set of zipper teeth 180 as it moves in the downward direction. Both of the sliders 160, 170, include a pull tab 190, which allows the wearer to move the sliders in the desired direction.

Figure 5:
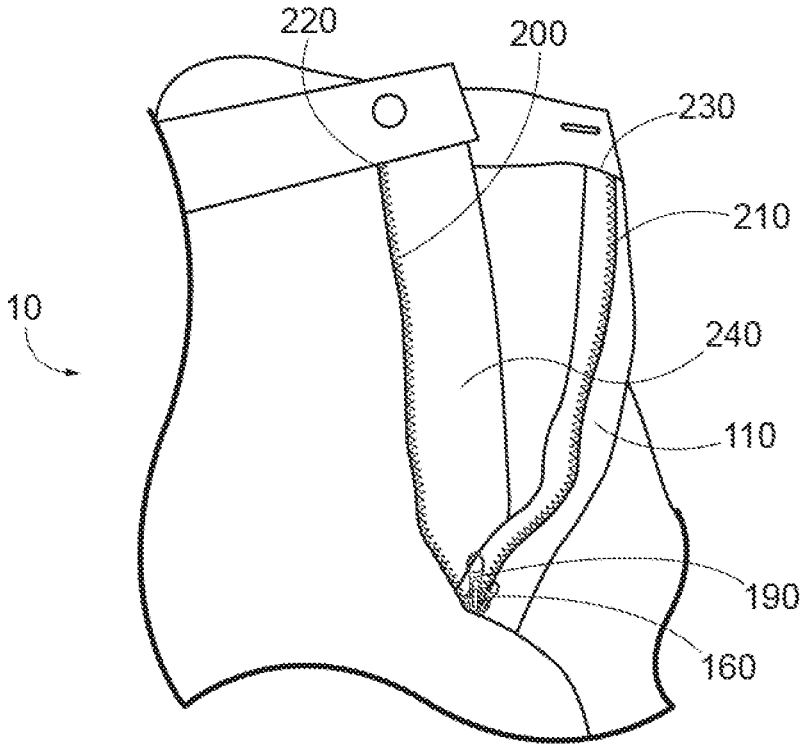
FIG. 5 is perspective view showing the fly of the pair of pants shown in FIG. 2 opened at the top.

FIG. 5 is perspective view showing the fly 100 of the pair of pants 10 shown in FIG. 2 opened at the top. Because the upper slider 160 has been moved in the downward direction, the common set of zipper teeth 180 are unzipped (i.e. open and separated), showing a first set of teeth 200 that mesh with a second set of teeth 210. Both sets of teeth 200, 210 terminate in upper zipper stops 220, 230, just below the belt line 60. The upper zipper stops 220, 230 prevent the upper slider 160 from proceeding beyond the belt line 60. The pull tab 190 of the upper slider 160 can be folded downwardly and concealed from view behind the outer flap portion 110.

Figure 6:
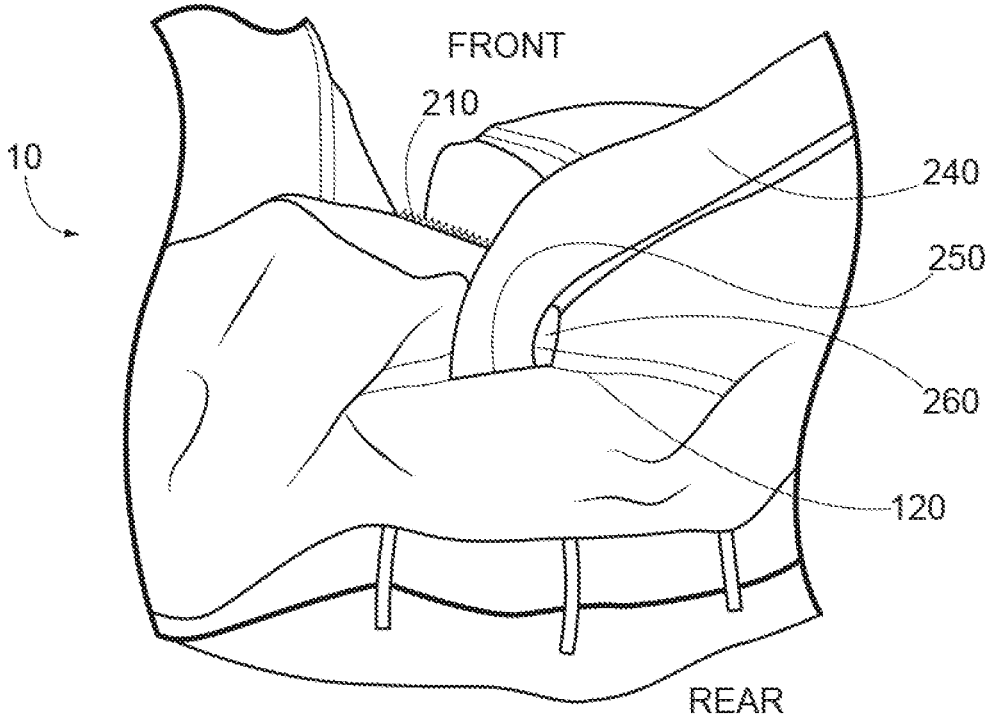
FIG. 6 is a perspective view showing the inner crotch area of the pants shown in FIG. 2 with the fly zipped down from the top.
Figure 7:
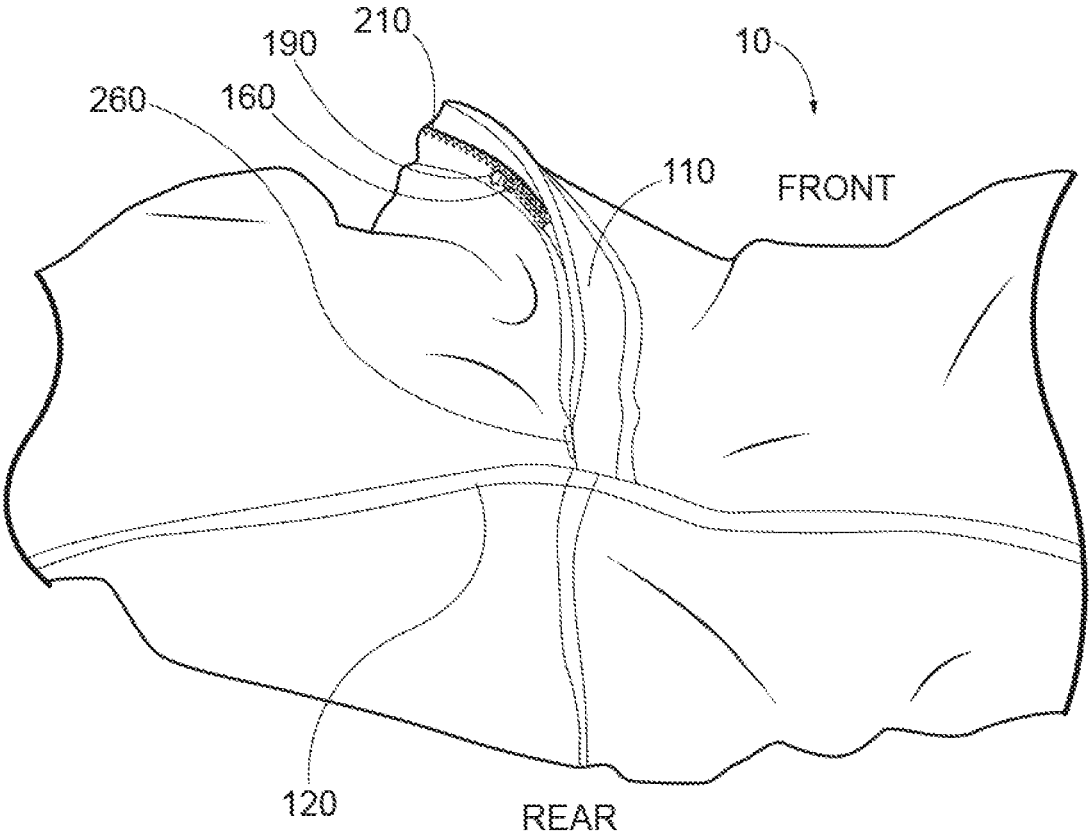
FIG. 7 is a perspective view from the bottom looking upwardly at the crotch area of the pants shown in FIG. 2.

FIG. 6 is a perspective view showing the inner crotch area of the pants shown in FIG. 2 with the fly zipped down from the top. An inner flap portion 240, which has a shape that is a mirror-image of outer flap portion 110, is anchored at the bottom 250 to the lateral crotch seam 120, which runs along and defines an inseam of the pants 10 down each portion 20, 30. Both sets of zipper teeth 200, 210 terminate in this seam, which functions as a zipper stop for the lower slider 170. Reinforcing stitching 260 is provided through the inner flap portion 240 and the outer flap portion (see FIG. 7), to anchor the flaps near the lateral crotch seam 120.

In a preferred embodiment, the pants 10 are configured as a pair of jeans made predominantly of denim fabric. But the pants could be made using any desired fabric. Similarly, double-stitched seams are shown in the preferred embodiment, but alternative stitching arrangements could also be used, if desired.

The top slider 160 functions in substantially the same manner as in traditional pants. It can be lowered from an uppermost raised position, which is just below the belt line 60, along the zipper teeth to a lowered position. In conventional pants, the lowered position is not at the lateral crotch seam of the pants, but rather is situated in a higher position on the front of the pants. The upper slider can be lowered as far as is necessary to allow a wearer to don the pants in the same manner as a traditional pair of pants, and also allows the wearer to lower the zipper in a traditional manner to excrete urine in a standing position. The lower slider 170 is particularly useful for opening the fly 100 while the wearer is in a seated position, which allows the wearer to excrete urine in the seated position.

Thus, the present invention provides a pair of pants comprising a fly that can be opened and closed via a bi-directional zipper that extends from a top end of the fly that is proximal to an upper terminus of the pants, preferably just below the belt line, to a bottom end of the fly that is at crotch point of the pants (i.e., the fly terminates at the lateral crotch seam of the pants). The bi-directional zipper includes a top slider and a bottom slider that are configured to travel on a common set of zipper teeth. The top slider is configured to separate the zipper teeth when moved in a direction away from the top end of the fly toward the bottom end of the fly and to close the zipper teeth back together when moved in a direction away from the bottom end of the fly toward the top end of the fly. And, the bottom slider is configured to separate the zipper teeth when moved in a direction toward the top end of the fly and away from the bottom end of the fly and to close the zipper teeth back together when moved in a direction toward the bottom end of the fly and away from the top end of the fly.

The present invention also provides a method comprising donning a pair of pants according to the invention such that the top slider is raised to the top end of the fly, the bottom slider is lower to the bottom end of the fly and the top closure for the fly is in a closed position, taking a seated position after donning the pair of pants, raising the bottom slider while in the seated position to open the fly while the top closure for the fly remains in the closed position, excreting urine through the opened fly, and returning the bottom slider of the pants to the bottom end of the fly after the excreting urine step has been completed. It will be appreciated that the excreting urine step of the method can be performed while seated in a motor vehicle, such as an aircraft in flight.

It will be appreciated that the material from which the pants are constructed is not per se critical, and that the pants could be constructed of any fabric that is suitable for manufacturing pants. Similarly, the length of the legs of the pants is also not per se critical. For example, the pant legs could extend to near the wearer's ankles (i.e., long pants) or could terminate at or near the wearer's knees (i.e., short pants).

It will also be appreciated that the manner in which the pants close at the waistline is also not per se critical. The pants can be closed using a button and loop, as in the illustrated embodiment. Alternatively, the pants can be closed using a snap or other conventional closure means.

The construction of the zipper is also not per se critical. It is preferably manufactured of metal, but can be made of other durable materials (e.g., nylon). Preferably, the pull tabs connected to the top and bottom sliders have no sharp corners, but rather are provided with rounded edges, which provide additional comfort. The length and positioning of the zipper must be sufficient that a wearer can comfortably excrete urine while in a seated position, with the bottom slider in a raised position.

Pants according to the invention are particularly useful for pilots, who cannot leave the seated position while operating an aircraft. However, the pants can also be worn by persons engaged in other pursuits, such as law enforcement, hunting, driving etc. The ability to raise the bottom slider without having to remove the belt to urinate is a substantial improvement and advantage in many circumstances.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A method for donning a pair of pants comprising: providing a pair of pants having a fly that is openable and closeable via a bi-directional zipper that extends from a top end of the fly that is proximal to an upper terminus of the pants to a bottom end of the fly that terminates at a lateral crotch seam defined by inseams of the pants, wherein the bi-directional zipper includes a top slider and a separate and distinct bottom slider that are each configured to travel on a common set of zipper teeth, wherein the top slider is configured to separate the common set of zipper teeth when the top slider is moved in a direction away from the top end of the fly toward the bottom end of the fly and to close the common set of zipper teeth back together when the top slider is moved in a direction away from the bottom end of the fly toward the top end of the fly, wherein the bottom slider is configured to separate the common set of zipper teeth when the bottom slider is moved in a direction toward the top end of the fly and away from the bottom end of the fly and to close the zipper teeth back together when the bottom slider is moved in a direction toward the bottom end of the fly and away from the top end of the fly; and wherein the lateral crotch seam functions as a zipper stop for the bottom slider that prohibits the bi-directional zipper from extending past the lateral crotch seam to a rear of the pants; donning the pair of pants such that the top slider is raised to the top end of the fly, the bottom slider is lowered to the bottom end of the fly and the top closure for the fly is in a closed position; taking a seated position after donning the pair of pants; raising the bottom slider while in the seated position to open the fly while the top closure for the fly remains in the closed position; excreting urine through the opened fly; and returning the bottom slider of the pants to the bottom end of the fly after the excreting urine step has been completed.

2. The method according to claim 1, wherein the excreting urine step is performed while seated in a motor vehicle.

3. The method according to claim 2, wherein the motor vehicle is an aircraft in flight.

* * * * *